US005434830A

United States Patent [19]

Martin

[11] Patent Number: 5,434,830

[45] Date of Patent: Jul. 18, 1995

[54] ULTRASONIC TRANSDUCER

[75] Inventor: Barry J. Martin, Guildford, Australia

[73] Assignees: Commonwealth Scientific and Industrial Research Organization, Campbell; AGL Consultancy Pty Ltd., North Sydney, both of Australia

[21] Appl. No.: 313,347

[22] Filed: Sep. 29, 1994

Related U.S. Application Data

[63] Continuation of Ser. No. 949,476, Oct. 23, 1992, abandoned.

[30] Foreign Application Priority Data

Apr. 27, 1990 [AU] Australia ..... PJ9873

[51] Int. Cl.[6] ..... H04R 17/00

[52] U.S. Cl. ..... 367/140; 367/157; 367/163; 367/174; 310/322; 310/334; 310/800

[58] Field of Search ..... 367/140, 157, 163, 174; 310/800, 322, 334

[56] References Cited

U.S. PATENT DOCUMENTS

| | | | |
|---|---|---|---|
| 3,115,588 | 12/1963 | Hueter | 310/800 |
| 3,816,774 | 6/1974 | Ohnuki et al. | 310/800 |
| 4,028,566 | 6/1977 | Franssen et al. | 310/9.5 |
| 4,056,742 | 11/1977 | Tibbetts | 310/357 |
| 4,284,921 | 8/1981 | Lemonon et al. | 310/328 |
| 4,578,613 | 3/1986 | Posthuma de Boer et al. | 310/800 |

FOREIGN PATENT DOCUMENTS

| | | | |
|---|---|---|---|
| 224503A1 | 10/1985 | Germany . | |
| 57-14283 | 1/1982 | Japan | H04R 17/00 |
| 59-174096 | 10/1984 | Japan | H04R 17/00 |
| 86764 | 7/1947 | New Zealand . | |
| 1504408 | 2/1975 | United Kingdom . | |
| 2059220 | 6/1980 | United Kingdom | H04R 1/22 |

OTHER PUBLICATIONS

Electronic Components, p. 3, Abstract No. 84–238076/39 DE 3309–234–A, *Ultrasonic transducer—with receiver layer and stack of radiator foils made of piezoelectric polymer*, Siemens AG, 15.03.83–DE–309234.

*Primary Examiner*—J. Woodrow Eldred

*Attorney, Agent, or Firm*—Sterne, Kessler, Goldstein & Fox

[57] ABSTRACT

Ultrasonic piezoelectric transducer comprising a piezoelectric material having a profile whereby the transducer transmits and/or receives ultrasonic vibrations in a dilational (quasilongitudinal) mode. The profile is curved and includes a point of inflection. Possesses a vibrational peak in the frequency range 10 KHz–200 KHz. Construction is performed via profiling and tensioning the piezoelectric material.

31 Claims, 13 Drawing Sheets

ULTRASONIC TRANSDUCER

This application is a continuation, of application Ser. No. 07/949,476, filed Oct. 23, 1992 now abandoned.

TECHNICAL FIELD

This invention relates to ultrasonic piezoelectric transducers, processes of constructing an ultrasonic piezoelectric transducer, a system for transmitting ultrasonic vibrations, a system for detecting ultrasonic vibrations, systems for transmitting and detecting ultrasonic vibrations, a method for transmitting ultrasonic vibrations, a method for detecting ultrasonic vibrations and methods for transmitting and detecting ultrasonic vibrations.

BACKGROUND ART

Occasionally situations arise that demand the use of an ultrasonic transducer in the 100–200 kHz range with minimal power requirements and operating into air or other gases. The low power requirement rules out a large number of existing transducers—whether their sensitivities are so poor that they need a large stimulating voltage or whether they need a large bias voltage which is difficult to achieve in a low power D.C. system. For example, piezoelectric ultrasonic transducers (commonly used underwater) operating into air or other gases are typically of low sensitivity or narrow bandwidth. These characteristics result from the immense acoustic impedance mismatch between air or other gases and the transduction materials (the latter being able to create large forces but with only small deflections). Either one puts up with the small deflections (low acoustic output) or one brings the material into a resonant state at one particular frequency. For echo sensing or information transmission applications a single frequency is useless and as broad a range of frequencies as possible is desirable. Some low-bias-voltage (30V) electrostatic transducers have been developed but, by and large, these are expensive and time-consuming to produce.

OBJECTS OF INVENTION

It is an object of this invention to provide an ultrasonic piezoelectric transducer.

Another object is to provide processes for constructing a piezoelectric transducer.

Other objects are to provide a system for transmitting ultrasonic vibrations, a system for detecting ultrasonic vibrations and systems for transmitting and detecting ultrasonic vibrations.

Further objects are to provide a method for transmitting ultrasonic vibrations, a method for detecting ultrasonic vibrations and methods for transmitting and detecting ultrasonic vibrations.

DISCLOSURE OF INVENTION

The present inventors have discovered that a piezoelectric material having an appropriate profile can be driven in a mode that is referred to in the specification and claims as a dilational mode which is alternatively referred to as a quasi-longitudinal mode. A tentative explanation of what is meant by a transducer being driven in a dilational mode is as follows. When a piezoelectric material having a curved profile is driven it will bulge out when it is lengthened and contract in when it is shortened. Where it is not curved no transverse motion results. Thus, if the material is gently curved but contains no point of inflection and thus no change in the sign of its curvature, it will undergo transverse vibration of the same phase along its whole length. If, on the other hand, the curve includes a point of inflection the transverse displacement changes in phase at this point. If this curvature having the point of inflection also possesses the appropriate radiation geometry there is a resultant effective coupling of piezoelectric excitation to transverse displacements whereby the out of phase transverse vibrations constructively interfere to give high output and when this occurs the piezoelectric material is being driven in a dilational mode. In this way a transducer possessing a high effective radiating area can be designed for ultrasonic frequencies having wavelengths are of the order of a few millimeters.

According to a first embodiment of this invention there is provided an ultrasonic piezoelectric transducer comprising a piezoelectric material having a profile whereby the transducer is capable of transmitting and/or receiving ultrasonic vibrations in a dilational mode.

The transducer of the first embodiment may further include means to profile the piezoelectric material, the means being operatively associated with the piezoelectric material.

The piezoelectric material of the transducer of the first embodiment may also be tensioned and may further include means to tension the piezoelectric material, the means being operatively associated with the piezoelectric material.

The piezoelectric material of the transducer of the first embodiment may have any profile which renders it capable of transmitting and/or receiving ultrasonic vibrations in a dilational mode. Typically, the profile is inverted U shaped or saddle shaped. Inverted U shaped means inverted with respect to the anchor points of the material. The profile may also be U shaped in which case it is not inverted with respect to the anchor points of the material.

According to a second embodiment of this invention there is provided an ultrasonic piezoelectric transducer comprising a piezoelectric material the piezoelectric material being profiled and tensioned whereby the transducer is capable of transmitting and/or receiving ultrasonic vibrations in a dilational mode together with means to profile and tension the piezoelectric material, the means being operatively associated with the piezoelectric material.

According to a third embodiment of this invention there is provided an ultrasonic piezoelectric transducer comprising a piezoelectric material having a profile and being tensioned, together with means to tension the material, the means being operatively associated with the material, whereby the transducer is capable of transmitting and/or receiving ultrasonic vibrations having a vibrational peak in the frequency range 10 kHz–200 kHz.

According to a fourth embodiment of this invention there is provided an ultrasonic piezoelectric transducer comprising a piezoelectric material being profiled and being tensioned, together with means to profile and tension the material, the means being operatively associated with the material, whereby the transducer is capable of transmitting and/or receiving ultrasonic vibrations having a vibrational peak in the frequency range 10 kHz–200 kHz.

Typically the range is 12 kHz–160 kHz, 80 kHz–120 kHz, 95 kHz–105 kHz, 15 kHz–60 kHz or 15 kHz–30

Khz. There may be more than one vibrational peak in the frequency range.

The means to tension and/or profile the piezoelectric material of the first, second, third or fourth embodiment may be adjustable so that the material can be tensioned and profiled so as to generate and/or receive ultrasonic frequencies in a variety of required ultrasonic frequency ranges.

The transducers of the first or second embodiments may comprise any piezoelectric material which is capable of transmitting and/or receiving ultrasonic vibrations in a quasi-longitudinal/dilational mode. Such materials include piezoelectric polymeric materials, plastics and rubbers. Advantageously the piezoelectric material comprises a poled polyvinylidene polymer, PVDF, or a copolymer of vinylidene fluoride and trifluoroethylene which may be in the form of a sheet, foil, film or other appropriate piezoelectric form. These materials are also suitable for the third and fourth embodiments.

According to a desired form of the first embodiment the piezoelectric material is saddle shaped as depicted in FIG. 9 where points A and C are points of anchor of the piezoelectric material, x is the length of the profile of the material between points A and C via Point B, $d_1$ is the distance between points A and C, $d_3$ is the distance between the tops of the saddle, $h_1$ is the height of the piezoelectric material to the top of the left hand saddle from a line joining points A and C, $h_r$ is the height of the piezoelectric material to the top of the right hand saddle from a line joining points A and C, $h_{2l}$ is the height of the left hand saddle of the piezoelectric material and $h_{2r}$ is the height of the right hand saddle of the piezoelectric material, and wherein:

$$1.5*d_1 \leqq x 2.3*d_1;$$

$$0.5*d_1 \leqq h_r \leqq 0.9*d_1;$$

$$0.5*d_1 \leqq h_1 \leqq 0.9*d_1;$$

$$0.1*d_1 \leqq h_{21} \leqq 0.2*d_1;$$

$$0.1*d_1 \leqq h_{2r} \leqq 0.2*d_1; \text{ and}$$

$$0.6*d_1 \leqq d_3 \leqq 0.8*d_1.$$

In one particularly desired form the piezoelectric material of the first, second, third or fourth embodiment is saddle shaped as depicted in FIG. 9 where $d_2$ is the cross sectional diameter of a bar operatively associated with the piezoelectric material to tension the piezoelectric material, points A and C are points of anchor of the piezoelectric material, x is the length of the profile of the material between points A and C via Point B, $d_1$ is the distance between points A and C, $d_3$ is the distance between the tops of the saddle, $h_1$ is the height of the piezoelectric material to the top of the left hand saddle from a line joining points A and C, $h_r$ is the height of the piezoelectric material to the top of the fight hand saddle from a line joining points A and C, $h_{21}$ is the height of the left hand saddle of the piezoelectric material and $h_{2r}$ is the height of the right hand saddle of the piezoelectric material, and wherein:

$$1.5*d_1 \leqq x \leqq 2.3*d_1;\ 0.5*d_1 \leqq h_r \leqq 0.9*d_1;$$
$$0.5*d_1 \leqq h_1 \leqq 0.9*d_1;\ 0.1*\ d_1 \leqq h_{21} \leqq 0.2*d_1;$$
$$0.1*d_1 \leqq h_{2r} \leqq 0.2*d_1;\ 0.05*d_1 \leqq d_2 \leqq 0.2*d_1; \text{ and}$$
$$0.6*d_1 \leqq d_3 \leqq 0.8*d_1.$$

More typically, $d_1=10$ mm; 15 mm$\leqq x \leqq$23 mm; 5 mm$\leqq h_r \leqq$9 mm; 5 mm$\leqq h_1 \leqq$9 mm; 1 mm$\leqq h_{21} \leqq$2 mm 1 mm; $\leqq h_{2r} \leqq$2 mm; 0.5 mm$\leqq d_2 \leqq$2 mm; and 6 mm$\leqq d_3 \leqq$8 mm.

Generally, $d_1=10$ mm; $x=20$ mm; $h_r=7.5$ mm; $h_1=7.5$ mm; $h_{21}=1.5$ mm; $h_{2r}=1.5$ mm; $d_2=1.0$ mm; and $d_3=6.9$ mm.

Typically $h_r$ is about the same (with 0.5 mm) or is the same as $h_1$ and $h_{2r}$ is about the same (within 0.5 mm) or is the same as $h_{21}$.

Advantageously, the piezoelectric material of the first, second, third or fourth embodiment comprises a poled polyvinylidene foil which is 5 μm to 75 μm thick, typically 9 μm to 35 μm thick, more typically, 20 μm to 25 μm thick, and even more typically 25 μm thick.

The piezoelectric material of the first, second, third or fourth embodiment may be an inverted U-shaped as depicted in FIG. 10 where points A and B are points of anchor of the piezoelectric material, x is the length of the profile of the material between points A and B via point C and $d_1$ is the distance between points A and B, wherein:

$$1.5*d_1 \leqq x \leqq 2.3*d_1.$$

More typically, $d_1=10$ mm; and 15 mm$\leqq x \leqq$23 mm.

Generally, $d_1=10$ mm; and $x=20$ min.

According to a fifth embodiment of this invention there is provided a process of constructing an ultrasonic piezoelectric transducer of the second embodiment, the process comprising:

profiling and tensioning a piezoelectric material whereby the material becomes capable of transmitting and/or receiving ultrasonic vibrations in a dilational mode.

According to a sixth embodiment of this invention there is provided a process of constructing an ultrasonic piezoelectric transducer of the fourth o embodiment, the process comprising:

profiling and tensioning a piezoelectric material whereby the transducer is capable of transmitting and/or receiving ultrasonic vibrations having a vibrational peak in the frequency range 15 kHz–130 kHz.

According to a seventh embodiment of this invention there is provided a system for transmitting ultrasonic vibrations comprising: an ultrasonic piezoelectric transducer of the first, second, third or fourth embodiment; and an ultrasonic ac source operatively associated with the transducer.

According to a eighth embodiment of this invention there is provided a system for detecting ultrasonic vibrations comprising: an ultrasonic piezoelectric transducer of the first, second, third or fourth embodiment; and an ultrasonic signal detector operatively associated with the transducer.

According to a ninth embodiment of this invention there is provided a system for transmitting and detecting ultrasonic vibrations comprising: an ultrasonic piezoelectric transducer of the first, second, third or fourth embodiment; an ultrasonic ac source operatively associated with the transducer; and an ultrasonic detector operatively associated with the transducer.

According to a tenth embodiment of this invention there is provided a system for transmitting and detecting ultrasonic vibrations comprising: a first ultrasonic piezoelectric transducer of the first, second, third or fourth embodiment; a second ultrasonic piezoelectric transducer of the first, second, third or fourth embodiment; an ultrasonic ac source operatively associated with the first and second transducers; and an ultrasonic detector operatively associated with the first and second transducers.

According to an eleventh embodiment of this invention there is provided a method for transmitting ultrasonic vibrations comprising: applying ultrasonic ac signals to a piezoelectric transducer of the system of seventh embodiment.

According to an twelfth embodiment of this invention there is provided a method for detecting ultrasonic vibrations comprising: detecting ultrasonic ac vibrations with a system of the eighth embodiment.

According to a thirteenth embodiment of this invention there is provided a method for transmitting and detecting ultrasonic vibrations comprising:

applying ultrasonic ac signals to a piezoelectric transducer of the system of ninth embodiment; and detecting ultrasonic ac vibrations with a system of the ninth embodiment.

According to a fourteenth embodiment of this invention there is provided a method for transmitting and detecting ultrasonic vibrations comprising:

applying ultrasonic ac signals to the first or second piezoelectric transducer of the system of tenth embodiment; and detecting ultrasonic ac vibrations generated by the second or first piezoelectric transducer with the second piezoelectric transducer of the system of the tenth embodiment.

In its most preferred form, the piezoelectric material is a piezoelectric foil which typically comprises a polyvinylidene fluoride ("PVDF") foil or a foil comprising a copolymer of PVDF. The foil has at least two electrodes located thereon, typically one electrode on each side of the foil. The electrodes may be the same or different material, typically the same material. Examples of electrode materials are metals such as Au, Pd, Pt, Ti, Zn, A1, Ag, Cu, Sn, Ga, In, Ni, conducting polymers which require doping with doping agents such as iodine, fluorine, alkali metals and their salts, metal carbonates and arsenic halides, include polyacetylene, polyacetylene copolymers, polypyrroles, polyacrylonitriles, polyaromatics, polyanilines, polythiophenes, polycarbazoles, polybetadiketone and polydipropargylamine, polyacenaphthene/N-vinyl heterocyclics with Lewis acids, poly(heteroaromatic vinylenes), polyphthalocyanines, polymer reacted with 1,9-disubstituted phenalene, polycarotenoids, heterocyclic ladder polymers, alternating aromatic and quinonoid sequences, polyisothianaphthene and poly(para-phenylene) sulphide and polymers which do not require doping such as poly(diether-linked bis-o-nitrile), polyacetylene and polydiacetylene with spacer units, poly(-perinaphthalene), poly(carbon diselenide), transition metal poly(benzodothiolene), poly(thiophene sulfonates) and acetylene-terminated Schiff base.

Generally, the width of the piezoelectric material is 1 mm–3500 mm, advantageously 1 mm–500 mm, typically 3 mm–100 mm, more typically 4 mm–40 mm, preferably 5 mm–20 mm and even more preferably 10 mm.

Also included within the scope of the invention are the following embodiments:

(i) An ultrasonic piezoelectric transducer comprising a piezoelectric material having a profile and being tensioned whereby the transducer is capable of transmitting and/or receiving ultrasonic vibrations in a dilational mode;

(ii) An ultrasonic piezoelectric transducer comprising a piezoelectric material the piezoelectric material being profiled and tensioned whereby the transducer is capable of transmitting and/or receiving ultrasonic vibrations in a dilational mode;

(iii) An ultrasonic piezoelectric transducer comprising a piezoelectric material having a profile and being tensioned whereby the transducer is capable of transmitting and/or receiving ultrasonic vibrations having a vibrational peak in the frequency range 10 kHz–200kHz; and (iv) An ultrasonic piezoelectric transducer comprising a piezoelectric material being profiled and being tensioned whereby the transducer is capable of transmitting and/or receiving ultrasonic vibrations having a vibrational peak in the frequency range 10 kHz–200 kHz.

BRIEF DESCRIPTION OF THE DRAWINGS

FIG. 6(*a*) also depicts a cylindrical crossbar 14;

FIGS. 11(*b*) depict modes 1 and 3 for them small and them greater than 20 degrees;

FIGS. 11(*c*) depict a saddle shaped uni-directional piezoelectric material. The arrow in the first diagram of the Figure depicts the active direction;

FIGS. 11(*d*) depict an inverted U-shaped uni-directional piezoelectric material. The arrow in the first diagram of the Figure depicts the active direction;

FIG. 11(*e*) is a graph of resonance frequency versus length of the piezoelectric material of FIG. 11(*d*);

BEST MODE AND OTHER MODES FOR CARRYING OUT THE INVENTION

The following describes the construction of an ultrasonic piezoelectric transducer designed to operate at around 100 kHz. The output of this transducer is relatively high (at around 1 Pa/V at 10 cm for its working area of 1 cm$^2$) and, compared to most other piezoelectric transducers, it has a broad bandwidth (around 30 kHz between 3 dB points). The reception sensitivity will depend on the type of amplifier applied to the transducer, as will the system noise (i.e. using a high input-impedance voltage amplifier will give different characteristics to a low input-impedance transconductance amplifier).

Figure 1:
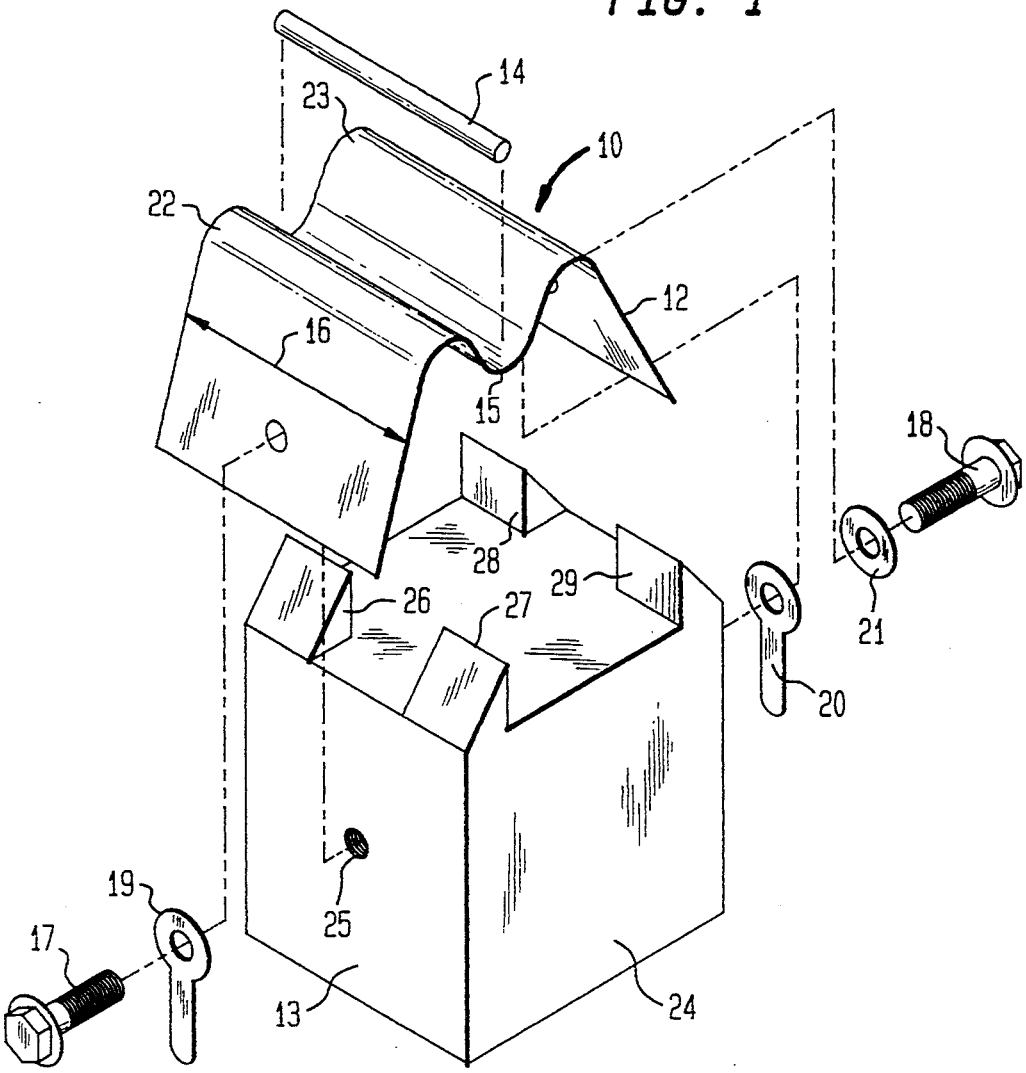
FIG. 1 is an exploded perspective view of an ultrasonic piezoelectric transducer of the invention together with a forming block and cross bar.
Figure 6A:
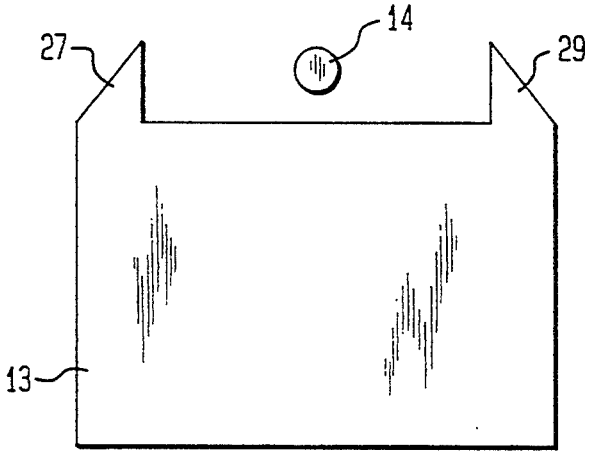
FIGS. 6(*a*) and 6(*b*) are front and side views respectively of the forming block 13 of FIG. 1 with dimensions shown in ram.
Figure 6B:
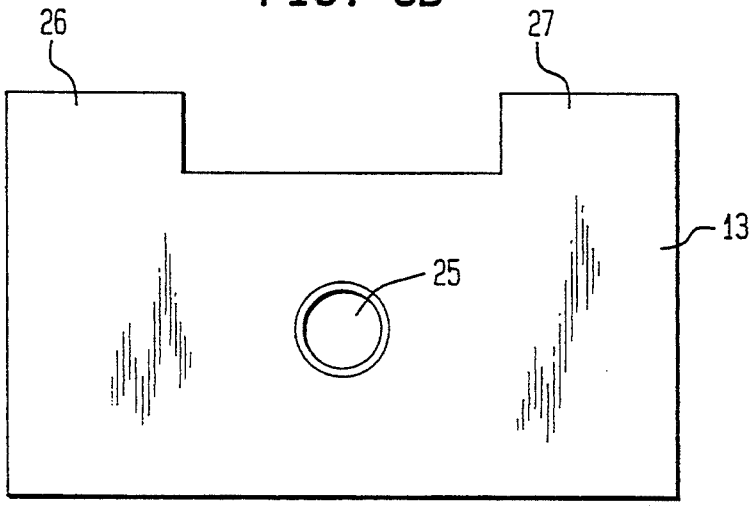

Referring to FIG. 1 a thin PVDF foil 10 with evaporated electrodes 11 and 12 is caused to bend over a forming block 13 having screw holes 25 (left screw hole shown only), by adjustable crossbar 14—typically of thin, stiff wire—as per FIG. 1. Dimensions of block 13 are shown in mm in FIGS. 6(*a*) and (*b*). The diameter of bend 15 in foil 10 is governed by the height of crossbar 14 above block 13. The diameter of bend 15 affects the frequency of operation (about 3 mm at 100 kHz) as does foil width 16 (about 1 cm at 100 kHz). Both of these dimensions also affect the amplitude of vibration (i.e. the transmission and receptive sensitivities). Foil 10 is fastened to block 13 by nylon screws 17 and 18, and washer 21 which is used in conjunction with screw 18, which also serve to bring the foil into contact with two terminals 19 and 20 which make contact with electrodes 11 and 12 respectively. The portions of foil 10 near to screws 17 and 18 may be treated with sodium hydroxide to remove the aluminium electrodes 12 and 11 respectively. This reduces the capacitance in parallel with the working part of foil 10 and improves both reception and transmission characteristics.

Figure 7:
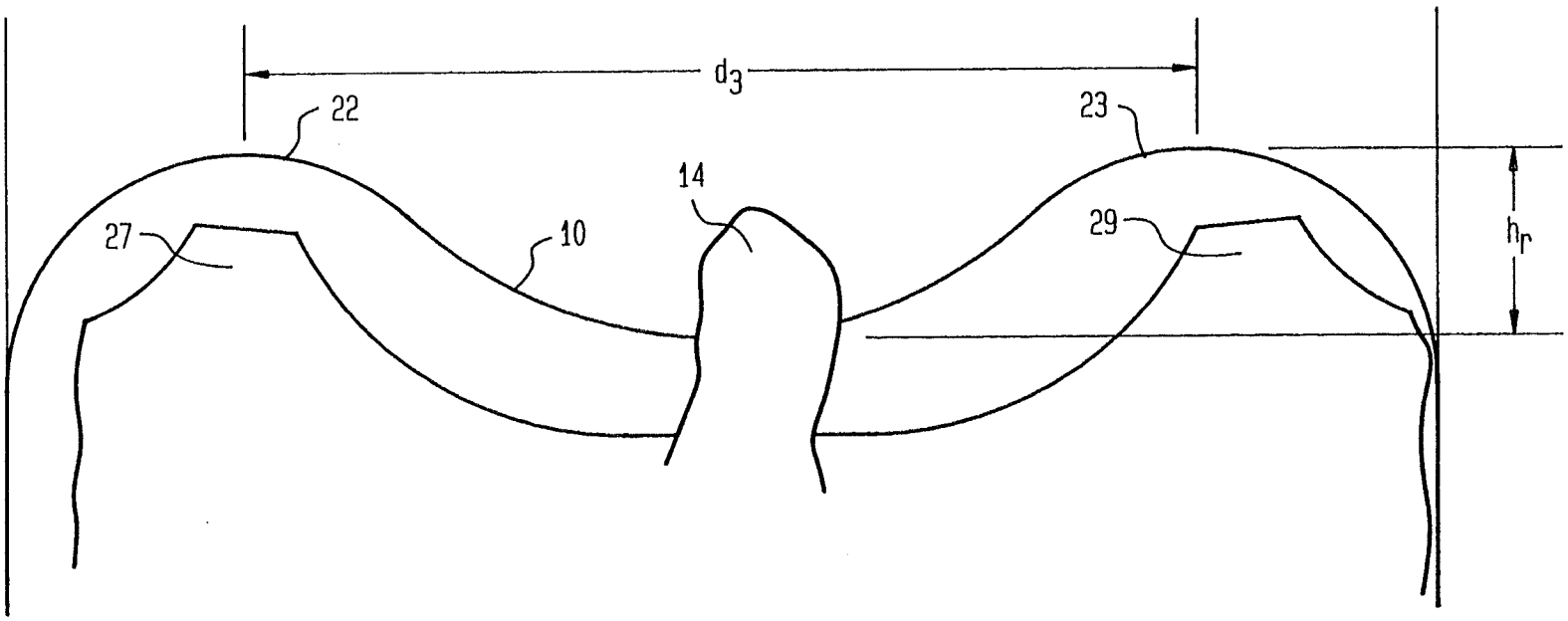
FIG. 7 is a magnified optical projection of an actual transducer foil profile.

The frequency of maximum acoustic output is close to the frequency predicted for a standing wave resonant across foil 10, however any resonance is largely smeared out due to the action of air or other gases imposing a bending resistance on foil 10 which has a low-acoustic-impedance. Holographic investigation of the mode of vibration indicates that most of the membrane movement normal to foil 10 about midway between the centre of bend 15 and tops of the two bends 22 and 23. FIG. 7 depicts a magnified optical projection of an actual transducer foil profile. Numbers corresponding to those of FIG. 1 have been added to FIG. 7 where appropriate to facilitate comparison. The edges at no point have any detectable normal motion. Nor does the centerline, beneath crossbar 14. Thus, to stop gross motion of foil 10, it can be supported at the edges at the tops of the bends 22 and 23 by support posts 26 and 27, and 28 and 29 respectively, as depicted in FIG. 1. The entire transducer of FIG. 1 is, except for radiating surfaces 22 and 23, ideally shrouded by a conductor to reduce electromagnetic and acoustic interference. The height of crossbar 14 can be adjusted by screw (moving forming block 13 relative to a body which supports crossbar 14) or simply by hand. Using either method takes a few seconds, and, given the simplicity of the component pans, the entire assembly should be inexpensive to produce.

Figure 8:
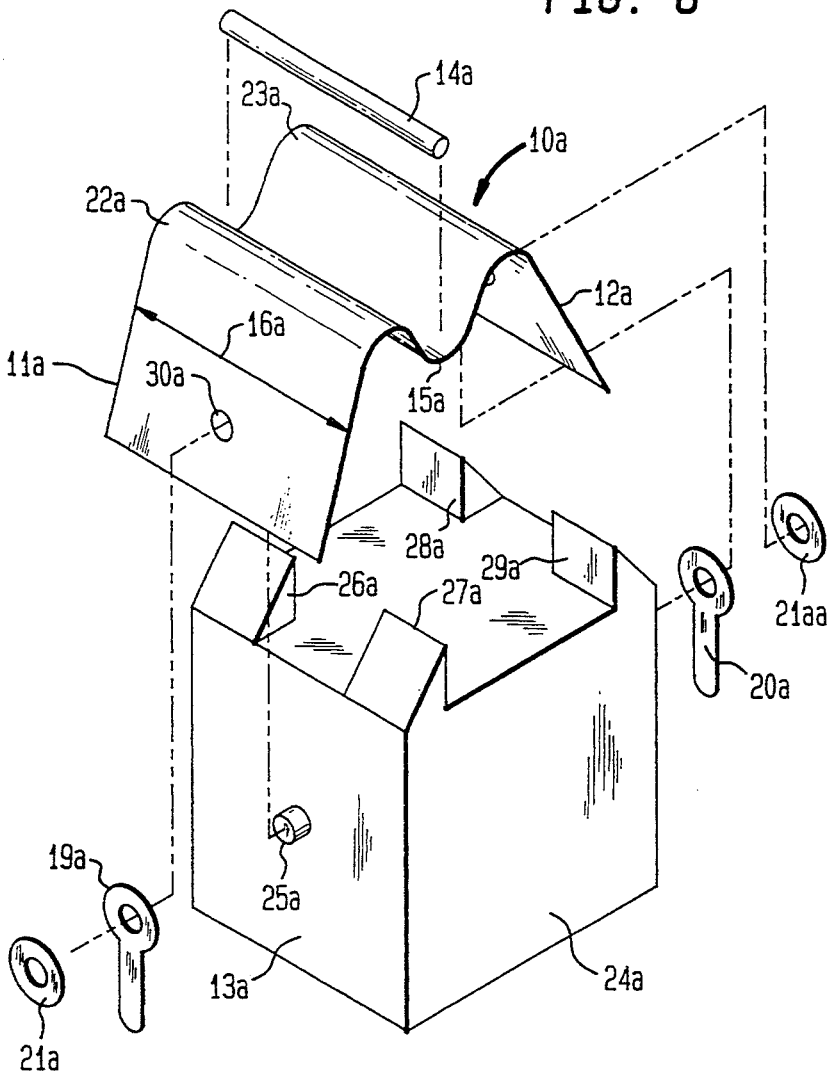
FIG. 8 is an exploded perspective view of an alternative ultrasonic piezoelectric transducer of the invention together with a forming block and cross bar.

A similar, but alternative, arrangement to that depicted in FIGS. 1, is depicted in FIG. 8. In this latter arrangement, a thin (generally 22 μm–25 μm, typically 25 μm) PVDF foil 10*a* with evaporated electrodes 11*a* and 12*a* is caused to bend over a plastic forming block 13*a* having lugs 25*a* on either side (left side shown only), by adjustable crossbar 14*a*—typically of thin, stiff wire housed in a plastic sleeve—as per FIG. 8. Dimensions of block 13 are as shown in mm in FIGS. 6(*a*) and (*b*). The diameter of bend 15*a* in foil 10*a* is governed by the height of crossbar 14*a* above block 13*a*. The diameter of bend 15*a* affects the frequency of operation (about 3 mm at 100 kHz) as does foil width (approximately corresponding to width 16*a* of block 13*a* (about 1 cm at 100 kHz). Both of these dimensions also affect the amplitude of vibration (i.e. the transmission and receptive sensitivities). Foil 10*a* is clamped to block 13*a* by locating holes 30*a* (left hand hole shown only) over lugs 25*a* (left hand lug shown only), placing plastic washers 21*a* and 21*aa* over lugs 25*a* to bring foil 10*a* into contact with two terminals 19*a* and 20*a* which make contact with electrodes 11*a* and 12*a* respectively. Foil 10*a* can be clamped into place about lugs 25*a* by locating clamping jaws about washers 21*a* and 21*aa*.

To stop gross motion of foil 10*a*, it is supported at the edges at the tops of the bends 22*a* and 23*a* by support posts 26*a* and 27*a*, and 28*a* and 29*a* respectively, as depicted in FIG. 8. The forming block 13*a* is preferably formed from an insulator. The height of crossbar 14*a* can be adjusted by hand which can take a few seconds, and, given the simplicity of the component parts, the entire assembly is inexpensive to produce.

Figure 9:
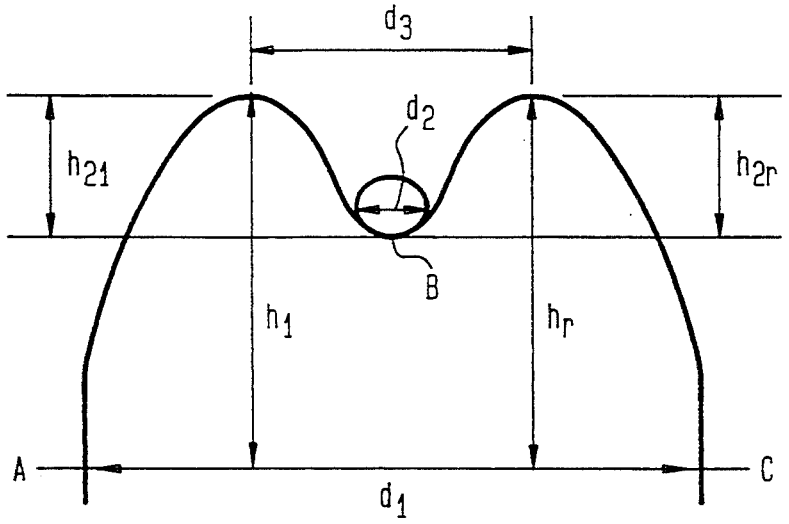
FIG. 9 is a cross sectional diagram of a piezoelectric material of FIG. 1 or 8.
Figure 10:
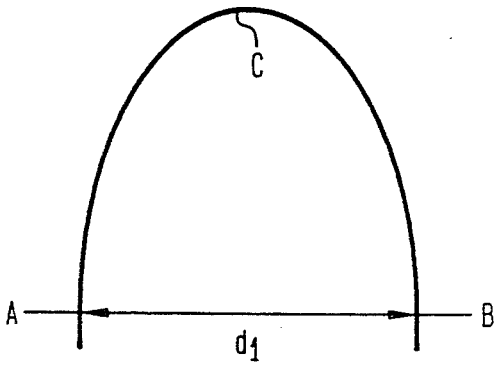
FIG. 10 is a cross sectional diagram of an inverted U shaped piezoelectric material.
Figure 11A:
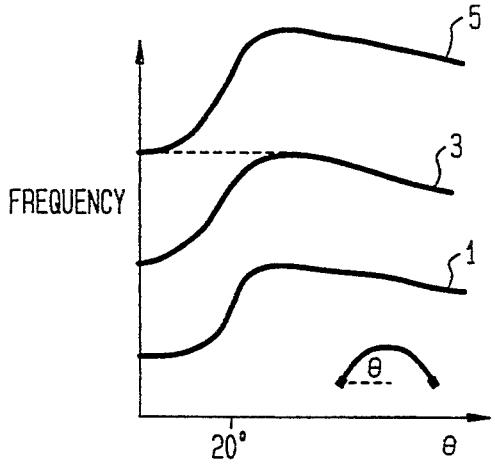
FIG. 11(*a*) is a graph of frequency dependence on angle them as shown for symmetric transverse modes of a piezoelectric foil. The sharp increase at about 20 degrees corresponds to a "buckling" of the mode.
Figure 11B:
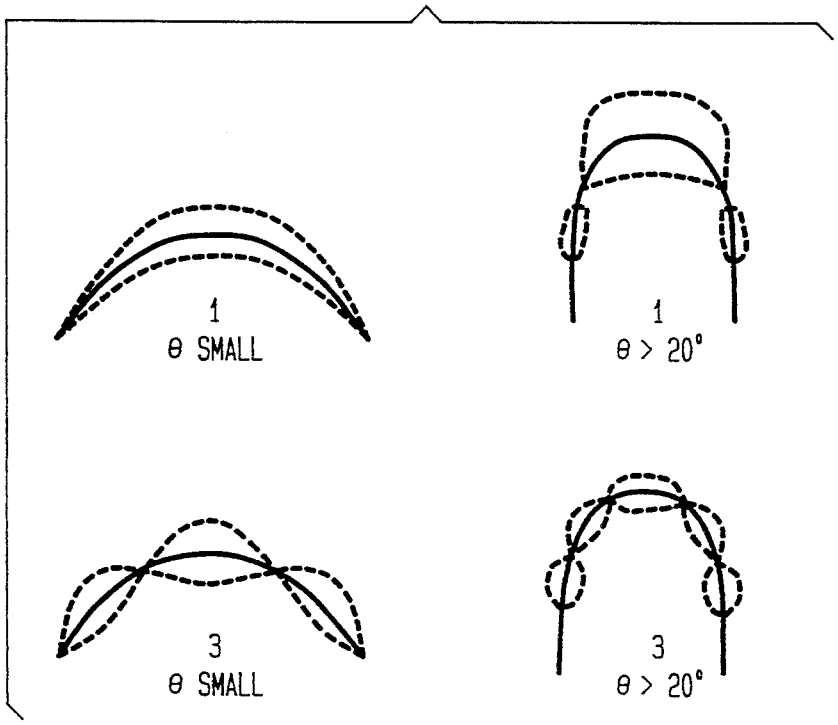
Figure 11C:
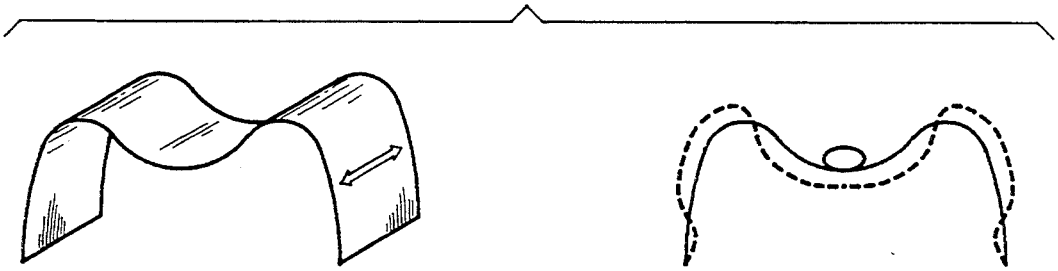
Figure 11D:
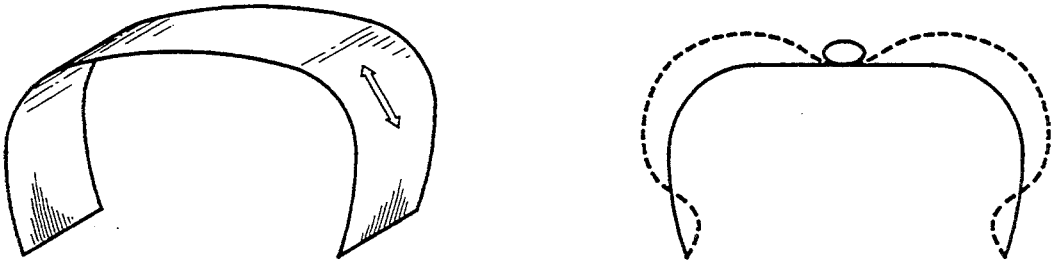
Figure 11E:
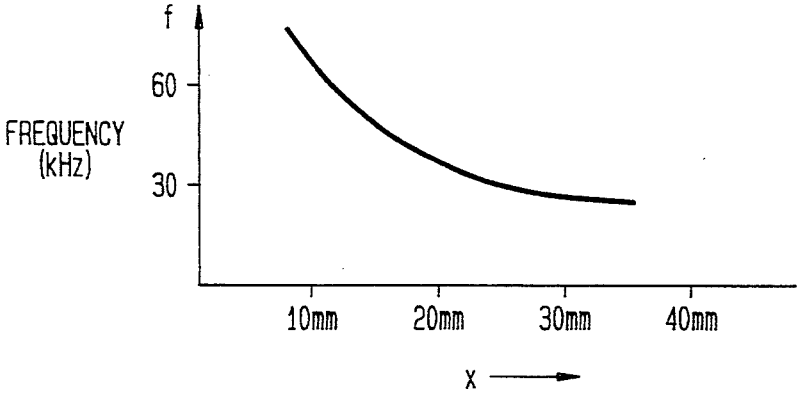
Figure 12A:
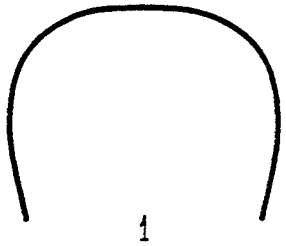
FIGS. 12 (1), (2), (3) and (4) depict the shapes of piezoelectric materials which were used in FIGS. 13–16.
Figure 12B:
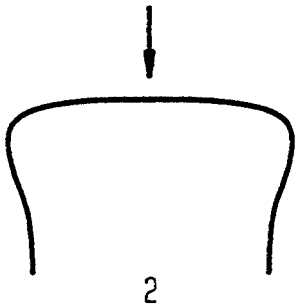
Figure 12C:
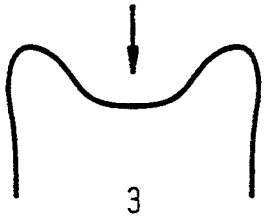
Figure 12D:
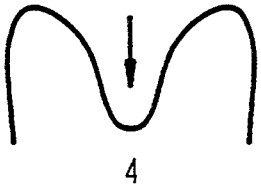
Figure 13A:
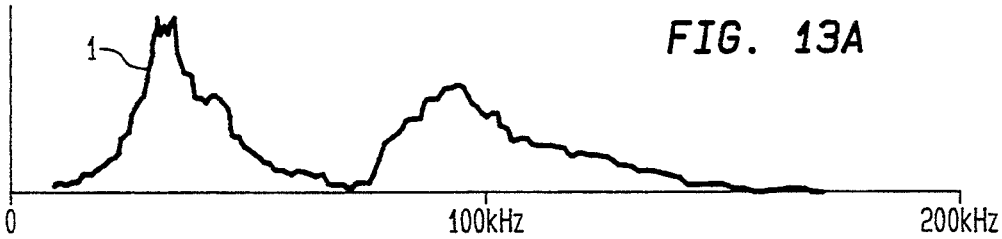
FIGS. 13(1)–(4) are power output versus frequency curves for $1\times2$ cm$^2$, mono-directional, longitudinal PVDF foil (outputs uncorrected for microphone response for shapes (1)–(4) of FIG. 12.
Figure 13B:
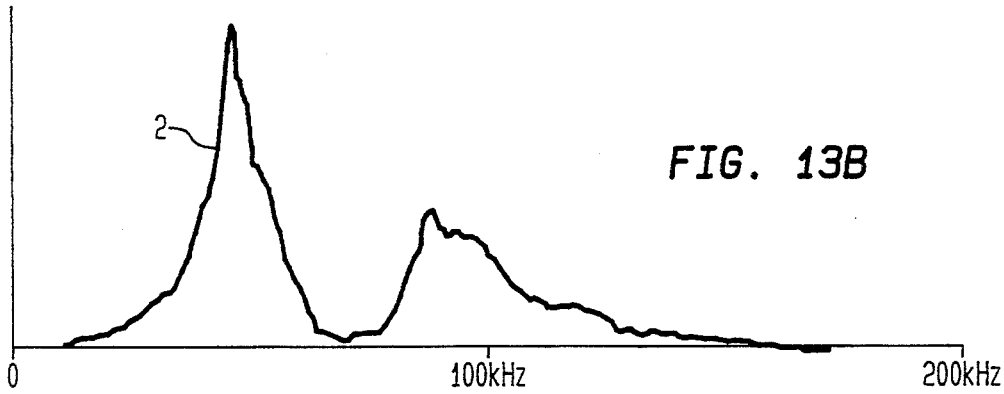
Figure 13C:
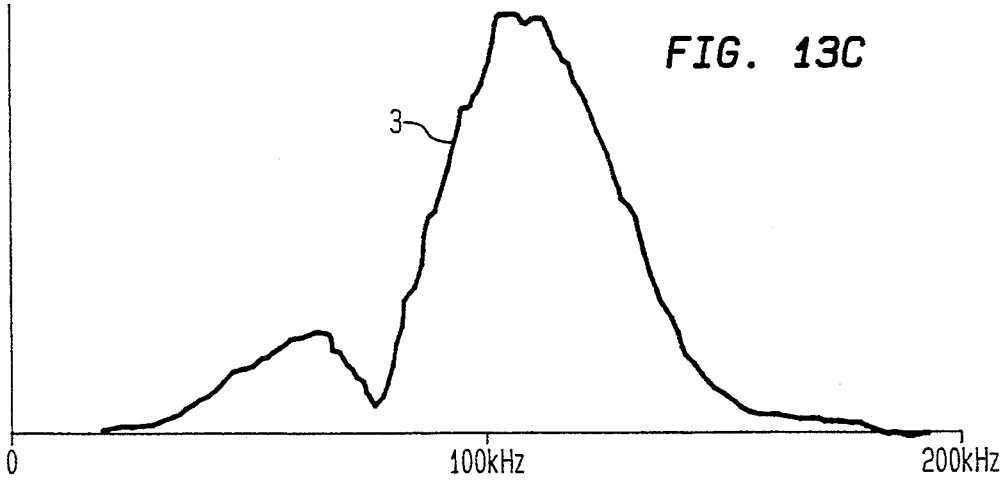
Figure 13D:
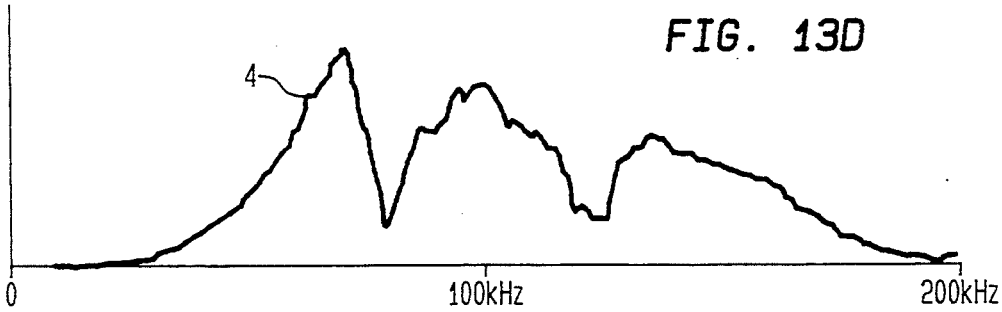
Figure 14A:
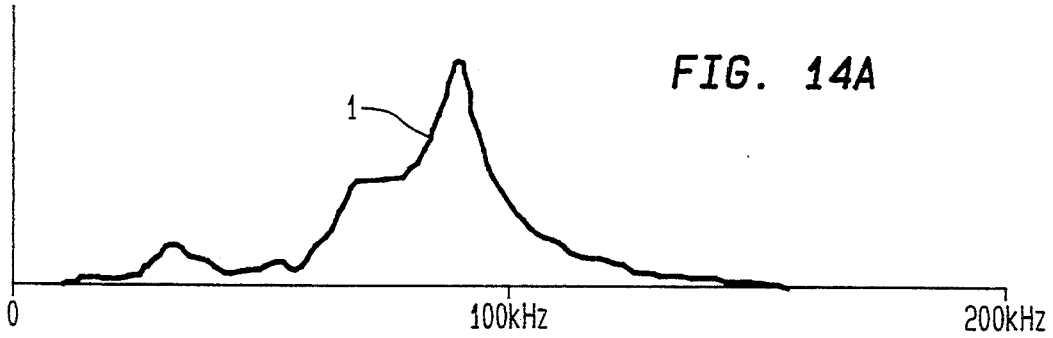
FIGS. 14(1)–(4) are power output versus frequency curves for $1\times2$ cm$^2$, mono-directional, transverse PVDF foil (outputs uncorrected for microphone response for shapes (1)–(4) of FIG. 12.
Figure 14B:
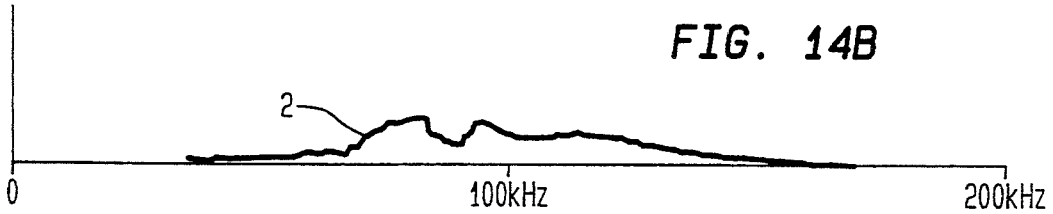
Figure 14C:
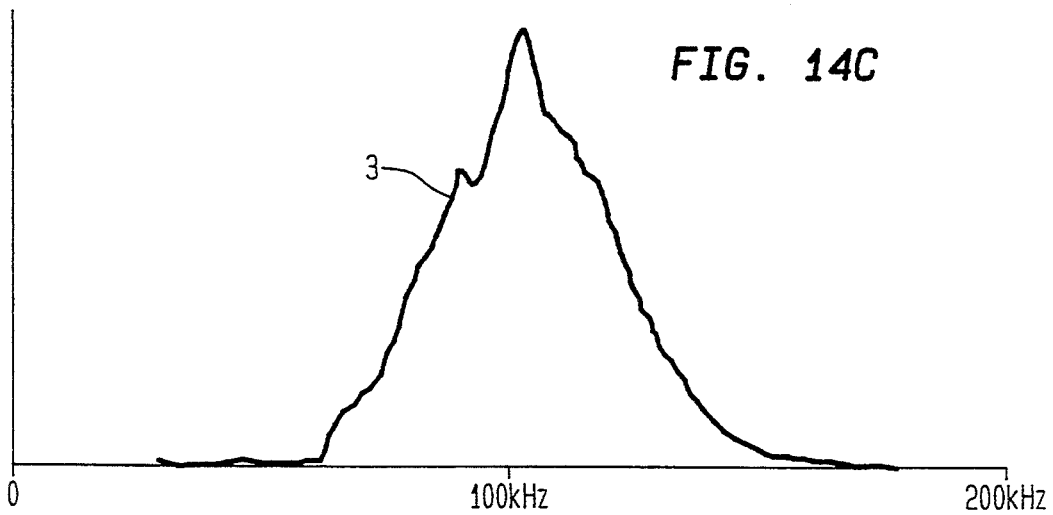
Figure 14D:
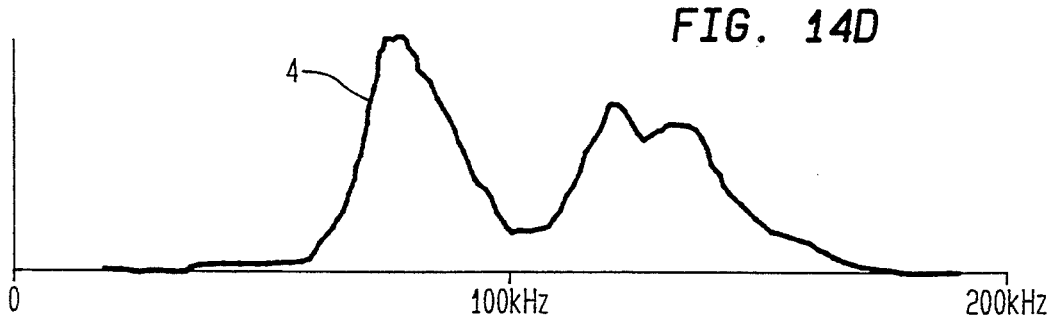
Figure 15A:
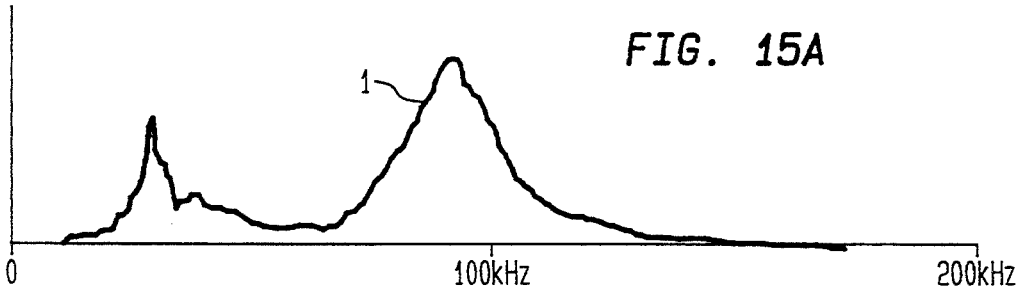
FIGS. 15(1)–(4) are power output versus frequency curves for $1\times2$ cm$^2$, bi-directional, PVDF foil (outputs uncorrected for microphone response for shapes (1)–(4) of FIG. 12.
Figure 15B:
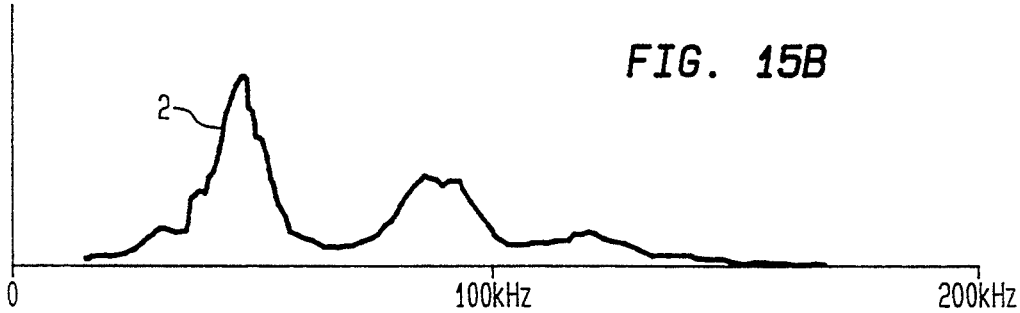
Figure 15C:
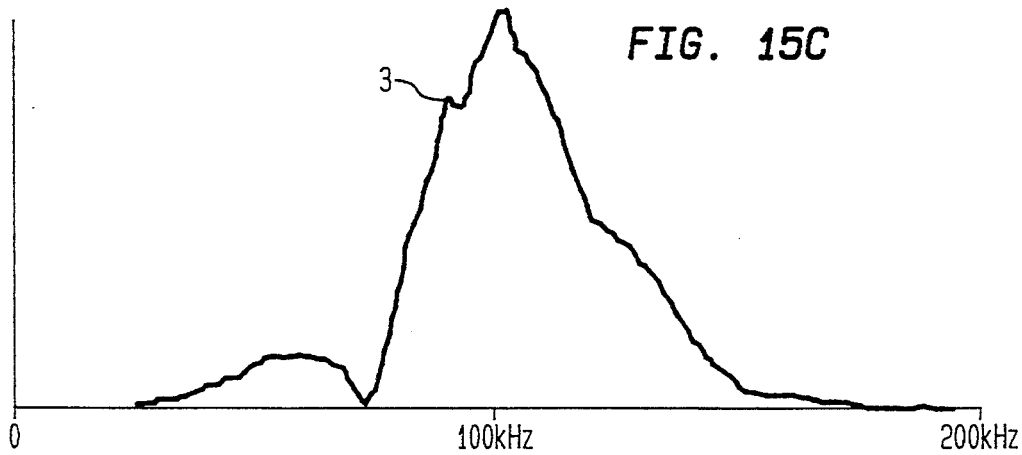
Figure 15D:
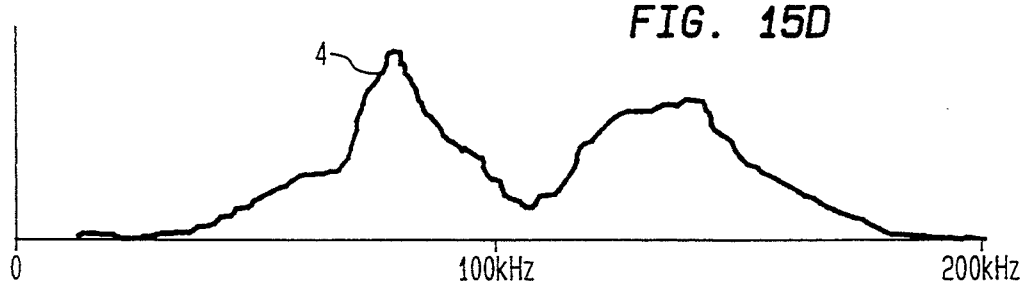
Figure 16:
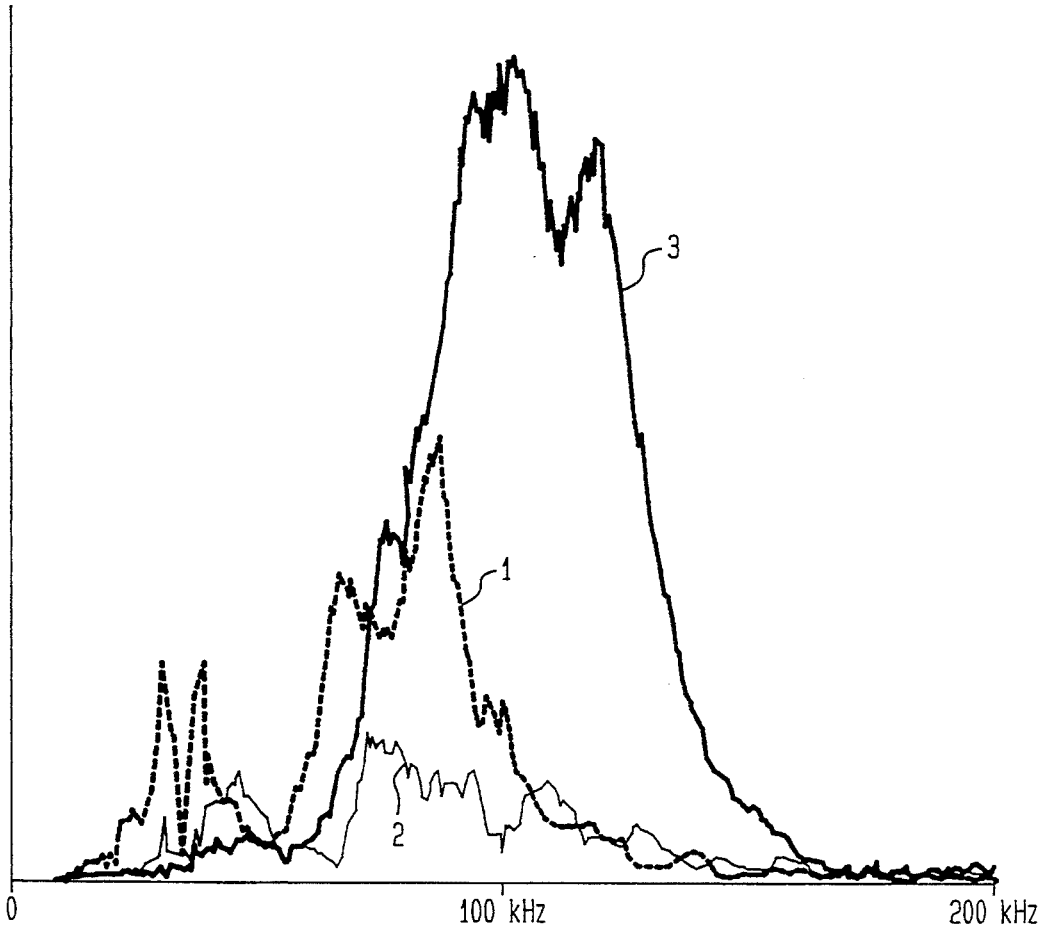
FIGS. 16(1)–(3) are power output versus frequency curves for $1\times2$ cm$^2$, mono-directional, transverse PVDF foil (outputs corrected for microphone response for shapes (1)–(3) of FIG. 12.

The piezoelectric material 10 of FIG. 1 or 10*a* of FIG. 8 is saddle shaped as depicted in FIG. 9 where $d_2$ is the cross sectional diameter of crossbar 14 or 14*a* operatively associated with the piezoelectric material to tension the piezoelectric material, points A and C are points of anchor of the piezoelectric material, x is the length of the profile of the material between points A and C via Point B, $d_1$ is the distance between points A and C, $d_3$ is the distance between the tops of the saddle, $h_l$ is the height of the piezoelectric material to the top of the left hand saddle from a line joining points A and C, $h_r$ is the height of the piezoelectric material to the top of the fight hand saddle from a line joining points A and C, $h_{21}$ is the height of the left hand saddle of the piezoelectric material and $h_{2r}$ is the height of the fight hand saddle of the piezoelectric material, and wherein:

$d_1=10$ mm; $x=20$ mm; $h_r=7.5$ mm; $h_l=7.5$ mm; $h_{21}=1.5$ mm; $h_{2r}=1.5$ mm; $d_2=1.0$ mm; and $d_3=6.9$ min.

The following describes an alternative construction of an ultrasonic piezoelectric material.

Figure 4:
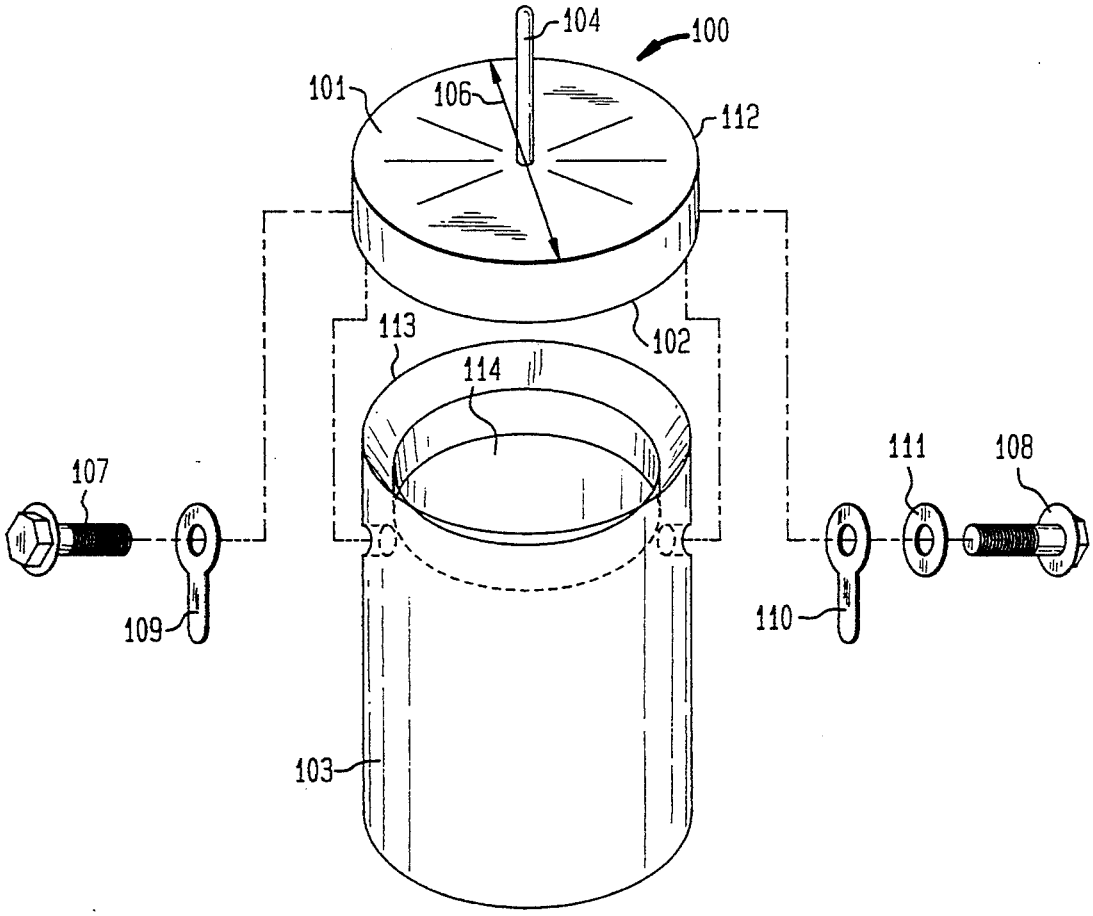
FIG. 4 is an exploded perspective view of an alternative ultrasonic piezoelectric transducer of the invention.

Referring to FIG. 4 a thin PVDF foil 100 with evaporated electrodes 101 and 102 is caused to bend over an cylindrical plastic forming block 103 by adjustable rod 104—typically of thin, stiff wire—as per FIG. 4. The degree of bend in foil 100 is governed by the height of rod 104 above base 114 in block 103. The degree of bend in foil 100 affects the frequency of operation as does foil diameter 106. Both of these dimensions also affect the amplitude of vibration (i.e. the transmission and receptive sensitivities). Foil 100 is fastened to block 103 by nylon screws 107 and 108, and washer 111 which is used in conjunction with screw 108, which also serve to bring the foil into contact with two terminals 109 and 110 which make contact with electrodes 101 and 102 respectively. The portions of foil 100 near to screws 107 and 108 may be treated with sodium hydroxide to remove the aluminium electrodes 102 and 101 respectively. This reduces the capacitance in parallel with the working pan of foil 100 and improves both reception and transmission characteristics.

To stop gross motion of foil 100, it can be supported at edge 112 by rim 113. Forming block 103 is preferably formed from an insulator and the entire device save for the radiating foil 100 is ideally shrouded by an aluminium conductor to reduce electromagnetic and acoustic interference. The height of rod 104 can be adjusted by screw (moving forming block 103 relative to a body which supports rod 104) or simply by hand (using the fiction between rod 104 and a hole in the forming block to hold it in position until it is finally glued).

Figure 2:
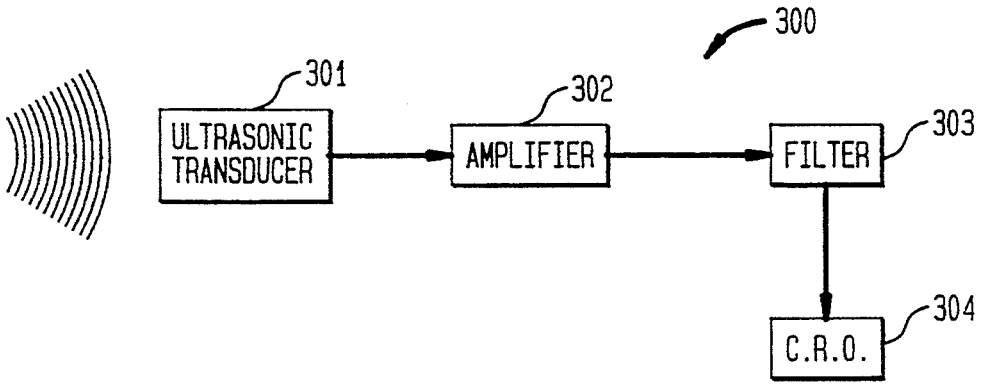
FIG. 2 is a block diagram of a circuit for detecting ultrasonic signals using an ultrasonic piezoelectric transducer of the invention.

FIG. 2 depicts schematically, in block diagram form, a system 300 for detecting ultrasonic vibrations. System 300 has an ultrasonic piezoelectric transducer 301 of FIG. 1, 8 or 4 and an amplifier 302 linked electrically to transducer 301. Amplifier 302 is linked, also electrically, to filter 303 which in turn is linked electrically to cathode ray oscilloscope 304.

In use, system 300 is located in an atmospheric environment in which ultrasonic waves are required to be detected. Ultrasonic vibrations in the air or other gases cause transducer 301 to vibrate ultrasonically and are convened to ultrasonic electrical signals by transducer 301. The ultrasonic electrical signals are amplified by amplifier 302, filtered by filter 303 and displayed on cathode ray oscilloscope 304.

Figure 3:
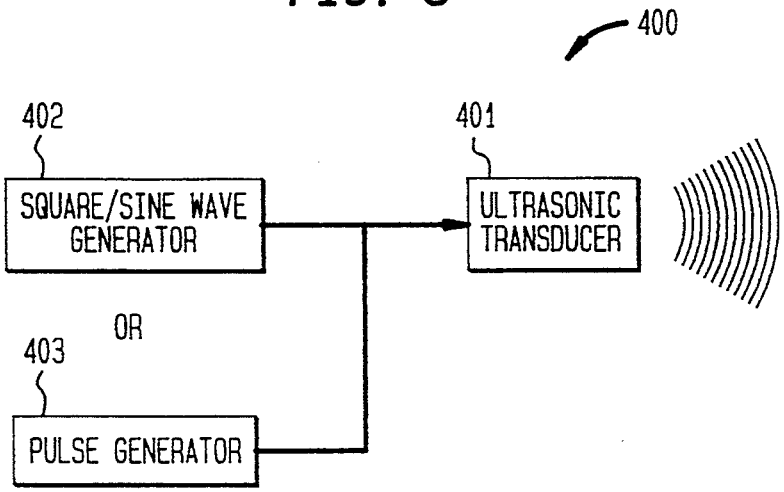
FIG. 3 is a block diagram of a circuit for transmitting ultrasonic signals using an ultrasonicpiezoelectric transducer of the invention.

FIG. 3 depicts schematically, in block diagram form, a system 400 for transmitting ultrasonic vibrations. System 400 has an ultrasonic piezoelectric transducer 401 of FIG. 1, 8 or FIG. 4 and ultrasonic square/sine wave generator 402 or ultrasonic pulse generator 403 linked electrically with transducer 401.

In use, system 400 is located in an atmospheric environment in which ultrasonic waves are required to be transmitted. Ultrasonic electrical signals which are applied to transducer 401 by square/sine wave generator 402 or pulse generator 403 cause transducer 401 to vibrate ultrasonically causing ultrasonic vibrations to be transmitted into the surrounding air or other gases.

Figure 5:
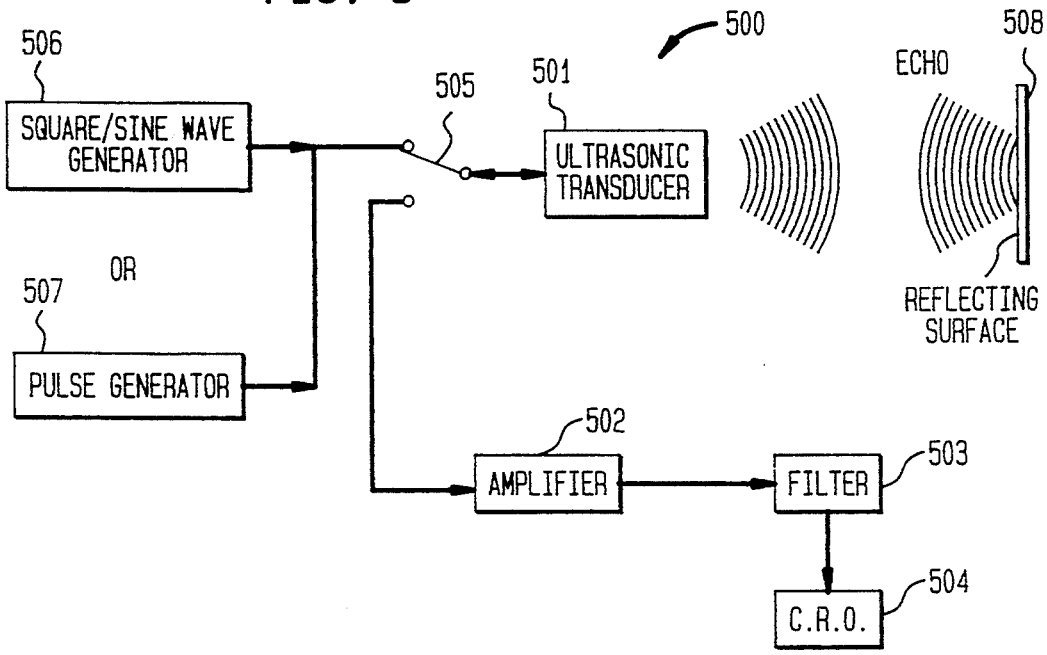
FIG. 5, depicts schematically, in block diagram form, a circuit for detecting and transmitting ultrasonic vibrations.

FIG. 5 depicts schematically, in block diagram form, a system 500 for detecting and transmitting ultrasonic vibrations. System 500 has an ultrasonic piezoelectric transducer 501 of FIG. 1, 8 or 4 and an amplifier 502 linked electrically to transducer 501 via switch 505. Amplifier 502 is linked, also electrically, to falter 503 which in turn is linked electrically to cathode ray oscilloscope 504. System 500 has an ultrasonic square/sine wave generator 506 or ultrasonic pulse generator 507 linked electrically to transducer 501 via switch 505.

In use, system 500 is located in an atmospheric environment in which ultrasonic waves are required to be detected. Ultrasonic vibrations in the air or other gases cause transducer 501 to vibrate ultrasonically and are converted to ultrasonic electrical signals by transducer 501. The electrical signals pass to amplifier 502 via switch 505 which links transducer 501 and amplifier 502 when system 500 is in the detection mode. The ultrasonic electrical signals are amplified by amplifier 502, filtered by filter 503 and displayed on cathode ray oscilloscope 504. In the transmitting mode ultrasonic electrical signals which are applied to transducer 501 by square/sine wave generator 506 or pulse generator 507 via switch 505 which links transducer 501 and generator 506 or 507, cause transducer 501 to vibrate ultrasonically causing ultrasonic vibrations to be transmitted into the surrounding air or other gases and can pass to reflecting surface 508 from which they are reflected and detected by system 500 in the detection mode.

Two systems 500 each having transducers according to FIG. 1, 8 or 4 as described immediately above may be placed at a distance from one another to alternatively transmit and receive ultrasonic signals to make measurements such as gas flow rate. An alternative system 500 having two transducers each according to FIG. 1, 8 or 4, where the transducers are placed at a distance from one another to alternatively transmit and receive ultrasonic signals to make measurements such as gas flow rate.

EXAMPLE 1

As has been indicated above, a piezoelectric material of the invention has a curvature having a point of inflection and it is thought that provided the curvature also possesses the appropriate radiation geometry there is a resultant effective coupling of piezoelectric excitation to transverse displacements whereby the out of phase transverse vibrations constructively interfere to give high output and. when this occurs that the transducer is being driven in a quasi-longitudinal/dilational mode, that is, generating surface motions parallel to the surface of the piezoelectric material. The function of the curvature of the transducer of the invention function is complex in three ways.

1. Where a length resonance is employed the frequency of the resonance increases with increasing curvature, the amount being related to the integral of the curvature along the foil. (FIG. 11(*a*))

2. Where the whole length of the foil is driven in phase, as is usually the case, a complex curvature serves to distribute transverse displacement response associated with the longitudinal dilations unevenly along the foil, the largest displacements being associated with the points of greatest curvature. At each point of inflection in the foil curvature the phase of the displacement reverses. (Phase reversals can also occur when there is no inflection if the curvature is high. This is illustrated in FIG. 11 (*b*).

3. The curved foil is the radiating shape of the transducer.

FIG. 11(*c*) illustrates the combining of these features in a 25 μm thick PVDF piezoelectric material about 10 mm wide and 20–30 mm in length used for gas velocity measurements in domestic gas. The optimum foil to use is the uni-directional one cut with the active direction across the strip since this suppresses the existence of a strong dilational mode in the length direction (however, a bi-directional PVDF could also be used). Were this present it would cause an additional response peak below the desired one giving low frequency undulations to the output. The foil is driven in the width direction at frequencies at and below the first width resonance. This vibration forces a corresponding periodic dilatation along the foil, via Poisson coupling, which is every where in phase. The foil was curved into the shape shown via clamps at each end and a retaining wire across the middle giving an effective radiating area of about 100 $mm^2$. The two high curvature mounds possess enhanced transverse motion and are in phase. In the depression between them the transverse motion is in opposite phase. The overall shape across the radiator integrates the output to give a strong broadband response around 100 kHz, wavelength=3 mm. This response is enhanced by the width resonance at about the same frequency.

A second configuration is shown in FIG. 11(*d*), suitable for lower frequency piezoelectric materials, 20–50 kHz. In this case a strip of the uni-directional foil was cut along the active direction and the strong dilational resonance along the foil was used as the basis for the .piezoelectric material. The foil is clamped in a simple inverted "U" shape and then the curved front of the inverted "U" was slightly flattened with a retaining wire. The optimum output is obtained when the foil is pushed in until the radiating surface was just short of being flat. At this point the whole radiating surface vibrates in phase. If the foil is made exactly flat a region in the middle appears having reverse phase which destroys the response. The operating frequency was determined by the length of the foil and second, by .the final complex curve and the results are illustrated in FIG. 11(*e*). A secondary effect of the retaining wire was to broaden the frequency response.

EXAMPLE 2

Theories of the propagation of sound in materials are normally continuum-based. However, the thickness of piezoelectric plastic films is typically 10 to 100 microns and therefore much smaller than the wavelengths propagated in the film, and continuum theory is not applicable. The treatment of acoustic wave propagation in thin films is therefore complicated and approximate only, but permits the identification of quasi-longitudinal or dilational waves primarily generating surface motions parallel to the film surface and to transverse waves. These waves can occur as irrotational or divergence-free waves and may also occur as volume waves or surface waves. ["Structure-Borne Sound", Cremer, Heckl & Ungar, Springer-Verlag, Berlin, 1973].

The following experiments in 25 μm thick PVDF film cut in 10×20 mm lengths demonstrate the effect of the foil geometry on the propagation of and interplay between the dilational and transverse waves. Furthermore intercomparison of the propagation spectra for uni-directional PVDF films cut parallel and transverse to the poling direction identify the peaks on the spectra as due to longitudinal or transverse waves.

Comparisons are made for the four configurations (all on 1×2 cm foils) depicted in FIGS. 12(*a*), 12 (*b*), 12(*c*) and 12(*d*), designated foil configurations (1), (2), (3) and (4) respectively.

FIGS. 13–16 of configurations (1) to (4) of PVDF film on a 1 cm base width establish the transfer of energy between the modes and demonstrate the criticality of shape/the optimization associated with the current piezoelectric material.

Using the terminology of FIG. 9, the overall length x partly determines the frequency, and the ratio $h_2$/length determines frequency and output.

Variations of up to ±0.5 mm in $h_{21}$ and $h_{2r}$ can be tolerated but thereafter there is a rapid decrease in output, e.g. ±1.0 mm causes a reduction of 4 in the signal.

The effect of the electrode mass on the transducer output was to decrease the amplitude i.e. the higher the molecular weight/density of the film and the thicker the electrode thickness, the lower is the amplitude of vibration and the output of the transducer, e.g. from A1-Ti-Ag-Au there is a drop off of dB in output.

EXAMPLE 3

Preliminary measurements were made on a circular piezoelectric material of 20 mm diameter of the type shown in FIG. 4. Compared with a transducer of the type shown in FIG. 1 or 8 the output was approximately 10 dB less but this does not account for the inefficient folds due to insufficient forming of the plastic in moulds.

INDUSTRIAL APPLICABILITY

An ultrasonic piezoelectric transducer of the invention is especially useful in systems for detecting and/or transmitting ultrasonic vibrations in air or other gases including gas for domestic, commercial or industrial use or fluids including water and sea water.

I claim:

1. An ultrasonic piezoelectric transducer capable of transmitting and receiving ultrasonic vibrations in a dilational mode, comprising a piezoelectric foil operatively associated with means supporting and tensioning said foil characterized in that:

said foil is profiled and tensioned by said means to form three curved segments wherein each curved segment has an opposite sign of curvature to an adjacent curved segment and is not fixed to said means, and wherein said foil is freestanding between each of said segments and is anchored to said means on either side of said three curved segments.

2. The transducer of claim 1 wherein said means includes support posts operatively associated with two of said three curved segments to support said two segments, said two segments being of the same sign of curvature.

3. The transducer of claim 1, wherein said means includes a support block on which said foil is mounted, said block having support posts operatively associated with two of said three curved segments to support said two segments, said two segments being of the same sign of curvature.

4. The transducer of claim 2, wherein said support posts are wedge shaped.

5. The transducer of claim 3, wherein said support posts are wedge shaped.

6. The transducer of claim 2, wherein said means supporting and tensioning said foil includes a tensioning bar operatively associated with one of said curved segments to tension said one of said curved segments, said one of said segments being of the opposite sign of curvature to said two segments.

7. The transducer of claim 3, wherein said means supporting and tensioning said foil includes a tensioning bar operatively associated with one of said curved segments to tension said one of said curved segments, said one of said segments being of the opposite sign of curvature to said two segments.

8. The transducer of claim 6, wherein said piezoelectric foil is shaped in cross-section as depicted in FIG. 9.

where $d_2$ is the cross-sectional diameter of said tensioning bar, points A and C are points of anchor of said piezoelectric foil, x is the length of the profile of said piezoelectric foil between points A and C via Point B, $d_1$ is the distance between points A and C, $d_3$ is the distance between the tops of said two curved segments, $h_1$ is the height of the piezoelectric foil to the top of the left hand curved segment of said two curved segments from a line joining points A and C, $h_r$ is the height of the piezoelectric foil to the top of the right hand curved segment of said two curved segments from a line joining points A and C, $h_{21}$ is the height of the left hand curved segment of said two curved segments and $h_{2r}$ is the height of the right hand curved segment of said two curved segments, and wherein:

$1.5*d_1 \leqq x \leqq 2.3*d_1$;

$0.5*d_1 \leqq h_r \leqq 0.9*d_1$;

$0.5*d_1 \leqq h_1 \leqq 0.9*d_1$;

$0.1*d_1 \leqq h_{21} \leqq 0.2*d_1$;

$0.1*d_1 \leqq h_{2r} \leqq 0.2*d_1$;

$0.05*d_1 \leqq d_2 \leqq 0.2*d_1$; and $0.6*d_1 \leqq d_3 \leqq 0.8*d_1$.

9. The transducer of claim 7, wherein said piezoelectric foil is shaped in cross-section as depicted in FIG. 9. where $d_2$ is the cross-sectional diameter of said tensioning bar, points A and C are points of anchor of said piezoelectric foil, x is the length of the profile of said piezoelectric foil between points A and C via Point B, d, is the distance between points A and C, $d_3$ is the distance between the tops of said two curved segments, $h_1$, is the height of the piezoelectric foil to the top of the left hand curved segment of said two curved segments from a line joining points A and C, $h_r$ is the height of the piezoelectric foil to the top of the right hand curved segment of said two curved segments from a line joining points A and C, $h_{21}$, is the height of the left hand curved segment of said two curved segments and $h_{2r}$ is the height of the right hand curved segment of said two curved segments, and wherein:

$1.5*d_1 \leqq x \leqq 2.3*d_1$;

$0.5*d_1 \leqq h_r \leqq 0.9*d_1$;

$0.5*d_1 \leqq h_1 \leqq 0.9*d_1$;

$0.1*d_1 \leqq h_{21} \leqq 0.2*d_1$;

$0.1*d_1 \leqq h_{2r} \leqq 0.2*d_1$;

$0.05*d_1 \leqq d_2 \leqq 0.2*d_1$; and $0.6*d_1 \leqq d_3 \leqq 0.8*d_1$.

$d_3 = 6.9$ mm.

10. The transducer of claim 1, wherein said transducer is capable of transmitting and receiving ultrasonic vibrations having a vibrational peak, in the frequency range 10 kHz–200 kHz.

11. An ultrasonic piezoelectric transducer capable of transmitting and receiving ultrasonic vibrations having a vibrational peak, in the frequency range 10 kHz–200 kHz, comprising a piezoelectric foil operatively associated with means supporting and tensioning said foil characterized in that:

said foil is profiled and tensioned by said means to form three curved segments wherein each curved segment has an opposite sign of curvature to an adjacent curved segment and is not fixed to said means, and wherein said foil is freestanding between each of said segments and is anchored to said means on either side of said three curved segments.

12. The transducer of claim 11, wherein said means includes support posts operatively associated with two of said three curved segments to support said two segments, said two segments being of the same sign of curvature.

13. The transducer of claim 11, wherein said means includes a support block on which said foil is mounted, said block having support posts operatively associated with two of said three curved segments to support said two segments, said two segments being of the same sign of curvature.

14. The transducer of claim 12, wherein said support posts are wedge shaped.

15. The transducer of claim 13, wherein said support posts are wedge shaped.

16. The transducer of claim 12, wherein said means supporting and tensioning said foil includes a tensioning bar operatively associated with one of said curved segments to tension said one of said curved segments, said one of said segments being of the opposite sign of curvature to said two segments.

17. The transducer of claim 13, wherein said means supporting and tensioning said foil includes a tensioning bar operatively associated with one of said curved segments to tension said one of said curved segments, said one of said segments being of the opposite sign of curvature to said two segments.

18. The transducer of claim 16, wherein said piezoelectric foil is shaped in cross-section as depicted in FIG. 9.

where $d_2$ is the cross-sectional diameter of said tensioning bar, points A and C are points of anchor of said piezoelectric foil, x is the length of the profile of said piezoelectric foil between points A and C via Point B, $d_1$ is the distance between points A and C, $d_3$ is the distance between the tops of said two curved segments, $h_1$ is the height of the piezoelectric foil to the top of the left hand curved segment of said two curved segments from a line joining points A and C, $h_r$ is the height of the piezoelectric foil to the top of the right hand curved segment of said two curved segments from a line joining points A and C, $h_{21}$ is the height of the left hand curved segment of said two curved segments and $h_{2r}$, is the height of the right hand curved segment of said two curved segments, and wherein:

$1.5*d_1 \leqq x2.3*d_1$;

$0.5*d_1 \leqq h_r \leqq 0.9*d_1$;

$0.5*d_1 \leqq h_1 \leqq 0.9*d_1$;

$0.1*d_1 \leqq h_{21} \leqq 0.2*d_1$;

$0.1*d_1 \leqq h_{2r} \leqq 0.2*d_1$;

$0.05*d_1 \leqq d_2 \leqq 0.2*d_1$; and $0.6*d_1 \leqq d_3 \leqq 0.8*d_1$.

19. The transducer of claim 17, wherein said piezoelectric foil is shaped in cross-section as depicted in FIG. 9:

where $d_2$ is the cross-sectional diameter of said tensioning bar, points A and C are points of anchor of said piezoelectric foil, x is the length of the profile of said piezoelectric foil between points A and C via Point B, $d_1$ is the distance between points A and C, $d_3$ is the distance between the tops of said two curved segments, $h_1$ is the height of the piezoelectric foil to the top of the left hand curved segment of said two curved segments from a line joining points A and C, $h_r$ is the height of the piezoelectric foil to the top of the right hand curved segment of said two curved segments from a line joining points A and C, $h_{21}$ is the height of the left hand curved segment of said two curved segments and $h_{2r}$ is the height of the right hand curved segment of said two curved segments, and wherein:

$1.5*d_1 \leqq x \leqq 2.3*d_1$;

$0.5*d_1 \leqq h_r \leqq 0.9*d_1$;

$0.5*d_1 \leqq h_1 \leqq 0.9*d_1$;

$0.1*d_1 \leqq h_{21} \leqq 0.2*d_1$;

$0.1*d_1 \leqq h_{2r} \leqq 0.2*d_1$;

$0.05*d_1 \leqq d_2 \leqq 0.2*d_1$; and $0.6*d \leqq d_3 \leqq 0.8*d_1$.

20. The transducer of any one of claims 8, 9, 18 or 19 wherein:

$d_1 = 10$ mm;

15 mm $\leqq x \leqq$ 23 mm;

5 mm $\leqq h_r \leqq$ 9 mm;

5 mm $\leqq h_1 \leqq$ 9 mm;

1 mm $\leqq h_{21} \leqq$ 2 mm;

1 mm $\leqq h_{2r} \leqq$ 2 mm;

0.5 mm $\leqq d_2 \leqq$ 2 mm; and 6 mm $\leqq d_3 \leqq$ 8 mm.

21. The transducer of any one of claims 8, 9, 18 or 19 wherein $d_1 = 10$ mm;

$x = 20$ mm;

$h_r = 7.5$ mm;

$h_1 = 7.5$ mm;

$h_{21} = 1.5$ mm;

$h_{2r} = 1.5$ mm;

$d_2 = 1.0$ mm; and $d_3 = 6.9$ mm

22. The transducer of any one of claims 1 or 11 wherein said foil comprises a material selected from the group consisting of a poled polyvinylidene polymer and a poled copolymer of vinylidene fluoride and trifluoroethylene.

23. The transducer of any one of claims 1 or 11, wherein said foil comprises a poled polyvinylidene polymer foil.

24. The transducer of any one of claims 1 or 11, wherein said foil comprises a poled polyvinylidene polymer foil which is 9 μm to 35 μm thick.

25. The transducer of any one of claims 1 or 11, wherein said foil comprises a poled polyvinylidene polymer foil which is 25 μm thick.

26. The transducer of any one of claims 1 or 11, wherein the width of said foil is 1 mm–500 mm.

27. The transducer of any one of claims 1 or 11 wherein the width of said foil is 5 mm–20 mm.

28. The transducer of any one of claims 1 or 11, wherein the width of said foil is 10 mm.

29. The transducer of any one of claims 1 or 11, wherein said transducer is capable of transmitting and receiving ultrasonic vibrations having a vibrational peak, in the frequency range 80 kHz–120 kHz.

30. The transducer of any one of claims 1 or 11, wherein said transducer is capable of transmitting and receiving ultrasonic vibrations having a vibrational peak, in the frequency range 15 kHz–60 kHz.

31. The transducer of any one of claims 1 or 11, wherein said transducer is capable of transmitting and receiving ultrasonic vibrations having a vibrational peak, in the frequency range 15 kHz–30 kHz.

* * * * *